US007197844B2

(12) United States Patent
Benson

(10) Patent No.: US 7,197,844 B2
(45) Date of Patent: Apr. 3, 2007

(54) GUN SUPPORT

(76) Inventor: Gary A. Benson, 5329 S. 179th St., West, Goddard, KS (US) 67052

( * ) Notice: Subject to any disclaimer, the term of this patent is extended or adjusted under 35 U.S.C. 154(b) by 102 days.

(21) Appl. No.: 10/920,909

(22) Filed: Aug. 18, 2004

(65) Prior Publication Data

US 2006/0037228 A1 Feb. 23, 2006

(51) Int. Cl.
*F41A 23/08* (2006.01)

(52) U.S. Cl. ..... 42/94; 89/37.03; 89/37.04; 248/593

(58) Field of Classification Search ..... 42/94, 42/37.03, 37.04; 89/37.04, 37.05, 1.35, 37.03; 211/64; 224/149, 150, 193, 198; 248/593
See application file for complete search history.

(56) References Cited

U.S. PATENT DOCUMENTS

| | | | | | |
|---|---|---|---|---|---|
| 1,853,802 | A | * | 4/1932 | Lefebvre D'Hellencourt | 42/51 |
| 2,264,791 | A | * | 12/1941 | Fries | 102/372 |
| 2,400,322 | A | * | 5/1946 | Wheeler | 89/37.19 |
| 3,235,997 | A | | 2/1966 | Stoner | |
| 3,235,998 | A | | 2/1966 | Hadley | |
| 3,388,227 | A | * | 6/1968 | Basso et al. | 200/296 |
| 4,017,997 | A | * | 4/1977 | Peterson et al. | 42/94 |
| 4,397,112 | A | | 8/1983 | York | |
| 4,903,629 | A | * | 2/1990 | Maudlin et al. | 114/361 |
| 4,991,839 | A | * | 2/1991 | Lumbattis, Jr. | 473/282 |
| 5,046,732 | A | * | 9/1991 | Chen | 473/523 |
| 5,233,779 | A | * | 8/1993 | Shaw | 42/94 |
| 5,333,829 | A | | 8/1994 | Bell et al. | |
| D356,137 | S | * | 3/1995 | Hull et al. | D22/108 |
| 5,421,115 | A | | 6/1995 | McKay | |
| 5,492,230 | A | * | 2/1996 | Horton | 211/70.2 |
| D386,298 | S | * | 11/1997 | Hancock | D3/218 |
| D386,304 | S | * | 11/1997 | Hancock | D3/262 |
| D390,301 | S | | 2/1998 | Peterson | |
| 5,915,572 | A | * | 6/1999 | Hancock | 211/64 |
| 6,209,827 | B1 | * | 4/2001 | Kawai | 248/73 |
| 6,283,875 | B1 | | 9/2001 | Jones | |
| 6,484,913 | B1 | * | 11/2002 | Hancock et al. | 224/401 |
| D476,290 | S | * | 6/2003 | Gates et al. | D12/408 |
| 6,588,637 | B2 | * | 7/2003 | Gates et al. | 224/546 |
| 6,637,707 | B1 | * | 10/2003 | Gates et al. | 248/224.7 |
| 6,663,731 | B1 | * | 12/2003 | Rose et al. | 149/42 |
| 6,695,183 | B2 | * | 2/2004 | Hancock et al. | 224/401 |
| 6,793,109 | B2 | * | 9/2004 | Gates et al. | 224/401 |
| 6,829,457 | B2 | * | 12/2004 | Ryuzaki et al. | 399/167 |
| D501,125 | S | * | 1/2005 | Winig et al. | D8/71 |
| 6,929,223 | B2 | * | 8/2005 | Hancock et al. | 248/74.2 |
| 2003/0116683 | A1 | * | 6/2003 | Turner et al. | 248/65 |

* cited by examiner

*Primary Examiner*—Stephen M. Johnson
(74) *Attorney, Agent, or Firm*—Hovey Williams LLP

(57) ABSTRACT

A bipod type gun support has a generally cylindrical hub that defines a barrel-receiving bore that can be slipped onto and off of the muzzle end of the gun. Downwardly diverging legs are integrally joined to opposite sides of the hub to present a one-piece construction. A slot along the top of the hub facilitates a slight amount of resilient flexing of sidewall portions of the hub toward and away from one another when the diverging legs are squeezed and released, thus enlarging the bore of the hub sufficiently to facilitate installation and removal of the support from the barrel. Preferably, the support is molded from a synthetic resinous material.

7 Claims, 3 Drawing Sheets

GUN SUPPORT

TECHNICAL FIELD

The present invention relates to the field of accessory equipment for guns, particularly shotguns, and relates more specifically to a bipod type support attachable to the barrel of the gun to support the barrel when the gun is placed on the ground or other surface.

BACKGROUND AND SUMMARY

Various types of bipod supports for shotguns and rifles are known in the art. However, conventional supports are unduly complex, costly, and made from a multitude of parts that can malfunction or become disassembled and lost.

The present invention provides a simple, one-piece support that is easy to use and install, will not interfere with the shooter's aiming or firing of the gun, and is rugged and long-lived. It can be installed on the gun without using any tools, and requires no modification of the gun itself. It causes no damage or injury of any kind to the gun when installed thereon. The support is particularly suited for use by waterfowl hunters who employ the technique of lying on their back in a field while covered with camouflage material, awaiting the arrival of game birds. Such hunters need a way of supporting the muzzle end of the gun barrel up and out of mud, debris and moisture while they rest the gun alongside themselves on the ground. It is also well suited for other types of still hunting, such as turkey and dove hunting, and can be used to support the gun for display purposes, such as on a mantel or shelf.

In one preferred embodiment, the support comprises a one-piece, integrally molded body having a generally horizontally extending, tubular hub that can be slipped onto and off of the muzzle end of the barrel. A pair of support legs diverge downwardly and outwardly from opposite sides of the hub and terminate in lowermost, ground-engaging tips that are adapted to keep the barrel up off the ground. Preferably, the support is constructed from a synthetic resinous material and has a slot along the top of the hub that permits opposed halves of the hub to be slightly resiliently opened and closed to facilitate installation and removal of the support from the gun barrel. The legs may be advantageously grasped and squeezed by the user to effect such resilient flexing of the hub.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
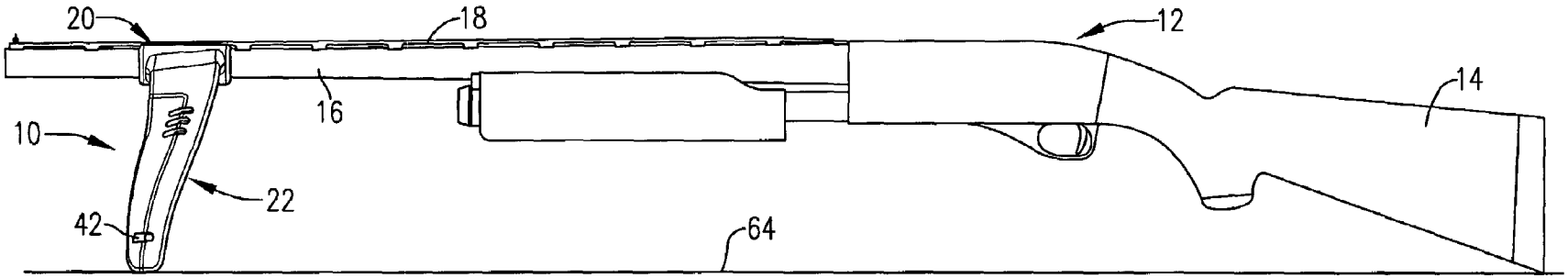
FIG. 1 is a side elevational view of a support in accordance with the present invention installed on a shotgun and supporting the barrel in a generally horizontal condition above a supporting surface.
Figure 2:
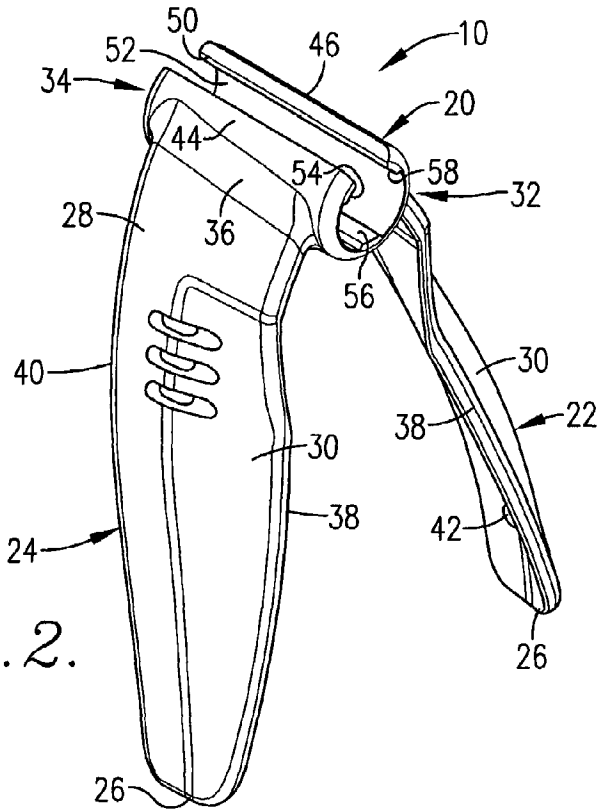
FIG. 2 is a top, front isometric view of the support.
Figure 3:
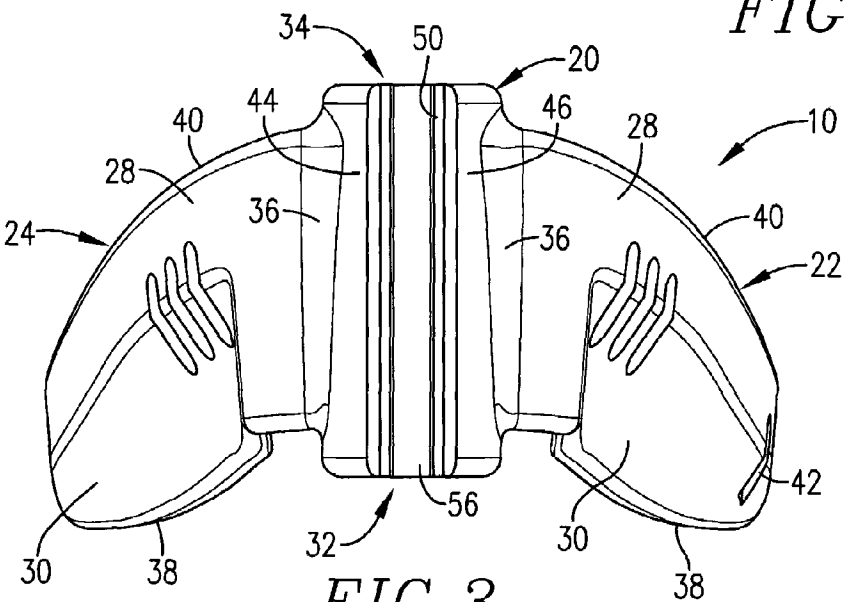
FIG. 3 is a slightly enlarged, top plan view thereof.
Figure 6:
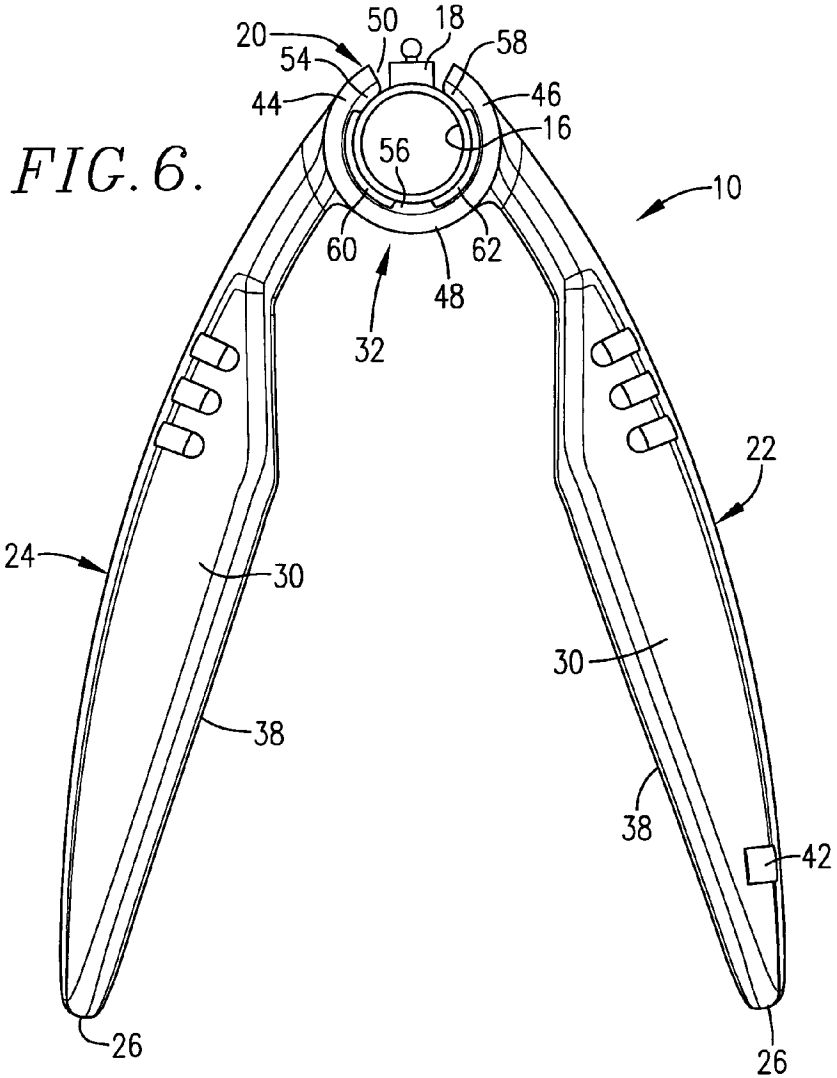
FIG. 6 is a front end elevational view of the support installed on the gun.
Figure 7:
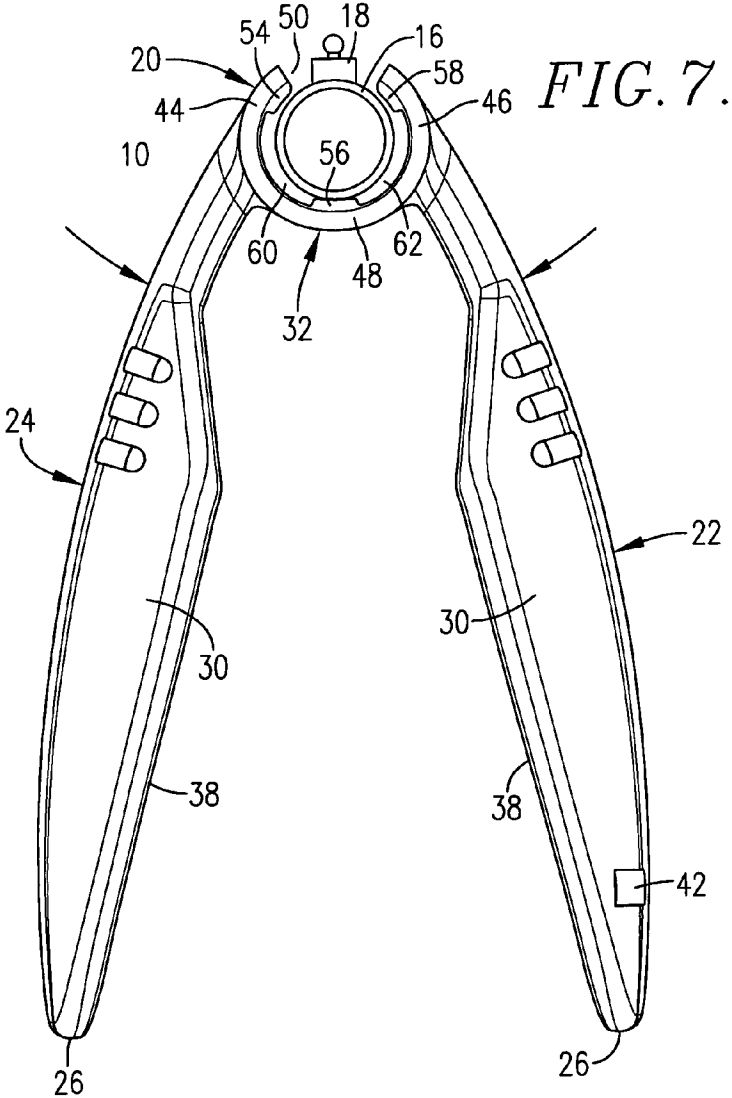
FIG. 7 is a front end elevational view of the installed supported as illustrated in FIG. 6 but showing the legs slightly squeezed together to enlarge the bore of the receiving hub to facilitate installation and removal of the support.

The support 10 as illustrated in FIG. 1 is adapted to be installed on a gun 12, particularly a shotgun, having a stock 14 and a barrel 16 among other components. A vent or rib 18 extends along the top of barrel 16 and is of generally rectangular cross-sectional configuration as illustrated in FIGS. 6 and 7.

Support 10 comprises a one-piece unitary body, preferably molded from a synthetic resinous material, having a normally horizontally extending, generally tubular, barrel-receiving hub 20 and a pair of supporting legs 22 and 24 integrally joined with hub 20. Legs 22 and 24 diverge outwardly away from one another as they extend downwardly away from hub 20 and are each slightly outwardly bowed along their longitudinal lengths. The lowermost tips 26 of legs 22, 24 are generally flat, presenting endmost edge surfaces that extend generally parallel with the longitudinal axis of hub 20. The corners of tips 26, both fore-and-aft, are rounded to avoid the presence of sharp points at those locations.

Each leg 22, 24 is generally flat and wide, having an outer surface 28 that faces laterally outwardly of hub 20 with its width running in the axial direction of hub 20. Each leg 22, 24 is provided with an inwardly beveled, generally flat portion 30 along the front edge 38 of the leg such that the two beveled portions 30 of the two legs 22, 24 cooperate to define a hand gripping area at the front 32 of support 10 that allows the legs 22, 24 to be gripped between the base of the user's thumb and the opposed fingers on the same hand when the support is grasped for installation and removal from barrel 16. The rear edge 40 of each leg 22, 24 at the rear 34 of support 10 is not beveled but is rounded and smooth to avoid sharp edges.

Figure 5:
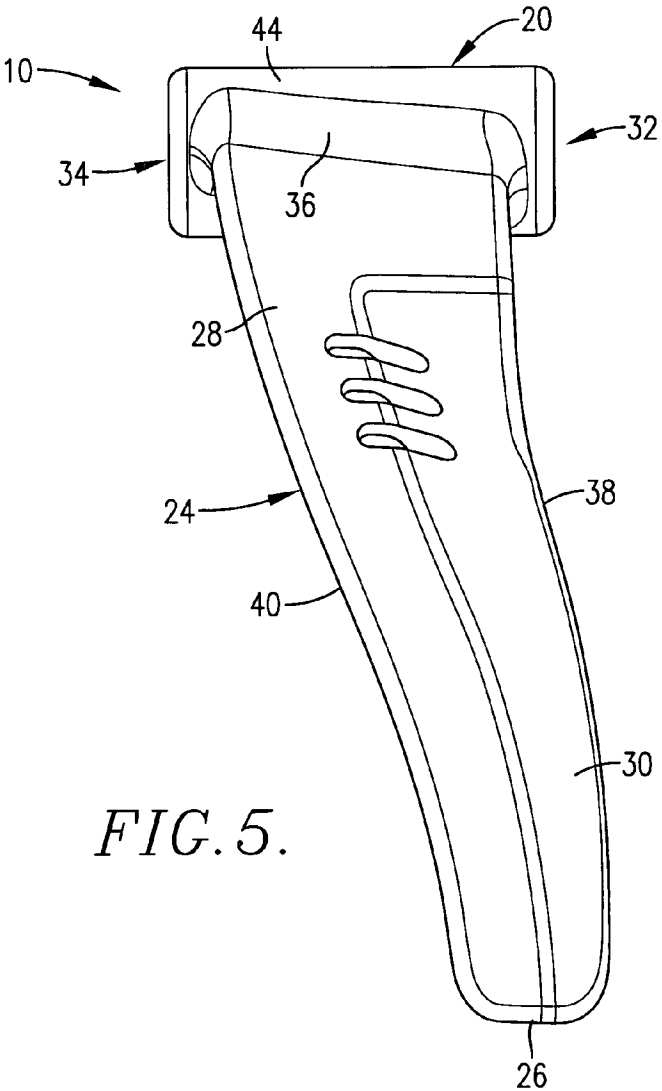
FIG. 5 is an elevational view of the opposite side of the support from that illustrated in FIG. 1.
Figure 4:
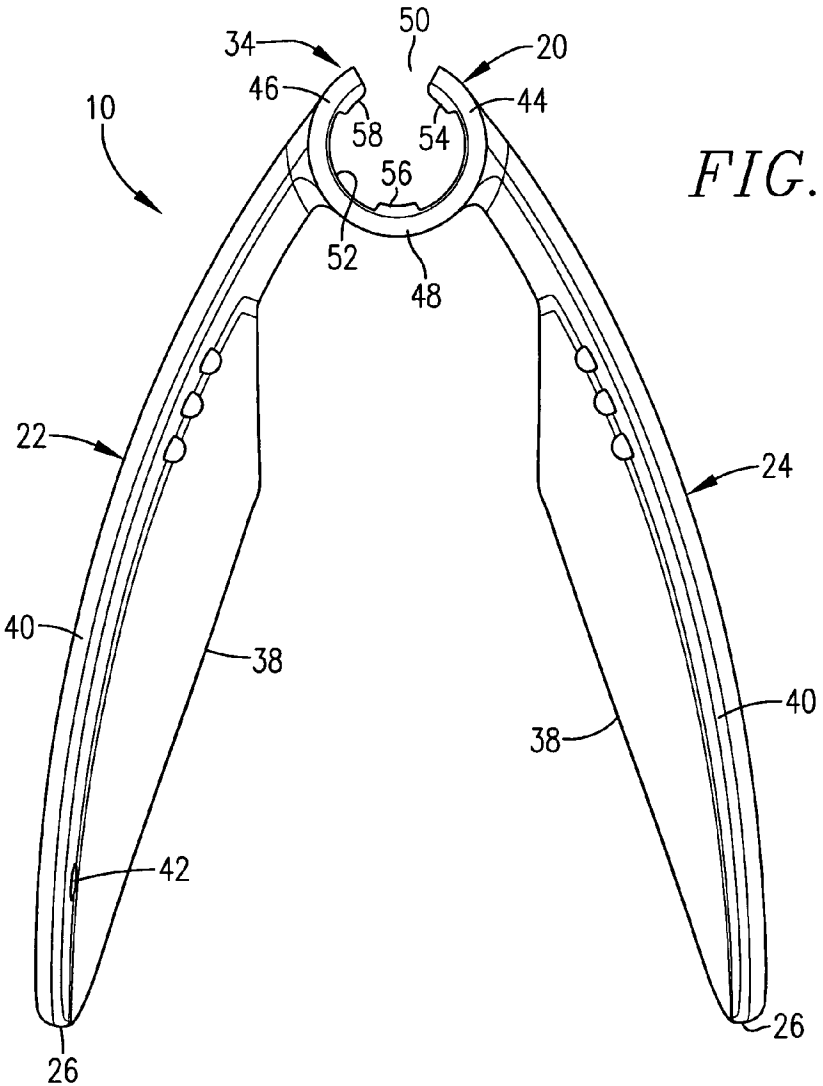
FIG. 4 is a rear elevational view of the support.

As illustrated perhaps best in FIG. 5, each leg 22, 24 is integrally joined to hub 20 along a line of junction 36 that extends generally downwardly and forwardly such that the plane of each leg 22, 24 is obliquely disposed with respect to the longitudinal axis of hub 20. The outer surface 28 of each leg 22, 24 thus tends to slope somewhat downwardly and inwardly as front 32 of support 10 is approached, such inclination being more dramatic in the area of beveled front portions 30. As a result of this construction, the front upright edges 38 of legs 22, 24 are disposed closer together than the upright rear or trailing edges 40 thereof. Leg 22 may be provided with a hole 42 adjacent its outer end through which a lanyard or the like may be threaded to facilitate carrying of support 10.

Legs 22 and 24 are joined to opposite side portions 44 and 46 of hub 20. Side portions 44 and 46 are integrally interconnected at their lower ends to present a bight 48 and are separated from one another at their opposite ends, i.e., the top of hub 20, to present a longitudinally extending slot 50 extending the full length of hub 20. Due to the tubular nature of hub 20, a central, generally circular bore 52 is defined therein, encompassed by side portions 44, 46 and bight 48. Three longitudinally extending projections in the form of ribs 54, 56 and 58 are formed on the interior surface of hub 20 and extend the full length thereof. Ribs 54, 56 and 58 project generally radially inwardly and serve as spacers to engage the outer diameter of barrel 16 and space the same from the otherwise circular inner surface of hub 20. As shown in FIG. 6, a pair of venting channels 60 and 62 are thus defined between hub 20 and barrel 16 when support 10 is installed thereon, such channels 60, 62 serving not only to reduce the transfer of heat from barrel 16 to hub 20 when the gun is fired, but also to provide an escape path for moisture between hub 20 and barrel 16.

As noted above, support 10 is preferably constructed from a suitable synthetic resinous material so as to permit injection molding thereof. Such material is so selected, and the dimensions of hub 20 and legs 22, 24 are such that, opposite sidewall portions 44, 46 of hub 20 may resiliently flex to a slight extent toward and away from one another about an integral fulcrum defined at bight 48, as illustrated in FIGS. 6 and 7. Thus, by gripping legs 22, 24 and squeezing them together to a slight extent as illustrated by the arrows in FIG. 7, bore 52 within hub 20 maybe slightly enlarged to facilitate slipping the support onto and off of the muzzle end of barrel 16. Once the support 10 is fully installed on the gun 12, release of the legs, 22, 24 allows sidewalls portions 44 and 46 to flex back toward one another, fully engaging all three ribs 54, 56 and 58 against barrel 16. With vent rib 18 located within slot 50, the support 10 cannot rotate to any significant extent about barrel 16 such that legs 22 and 24 are always in their proper locations for supporting gun 12 as illustrated in FIG. 1.

It will be noted that when support 10 is installed on gun 12, no portion of support 10 projects upwardly beyond vent rib 18. Consequently, support 10 may remain in place during firing of the gun without interfering with the shooter's line of sight. Yet, if the shooter desires to remove support 10, it is a simple matter to quickly grasp legs 22, 24 and squeeze them inwardly to release hub 20 and allow the support to be slipped off barrel 16.

It will thus be appreciated that support 10 provides a convenient, sturdy and easy-to-use support for keeping barrel 16 up out of the moisture, mud and debris normally associated with field hunting conditions. It is lightweight, can be quickly and easily installed and removed, and utilizes a one-piece, unitary construction to facilitate manufacture and avoid the loss of separate components. By being molded from a synthetic resinous material, the support is virtually impervious to all adverse environmental conditions.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

The invention claimed is:

1. The combination comprising:

a gun having an elongated barrel and a stock presenting an end that is remote from the barrel; and a gun support comprising a one-piece body having a hub presenting a bore and a pair of supporting legs integrally connected to said hub on opposite sides thereof, said bore having an internal diameter and said hub having an axial length greater than said internal diameter of the bore, said barrel being received within said hub bore and said legs having lowermost tips adapted to contact a supporting surface so that the barrel is disposed above the supporting surface when the tips of the legs and the remote end of the stock are placed in engagement with the supporting surface, said opposite sides of the hub being disconnected from one another along a portion of the hub to present a slot, said body being constructed to permit said opposite sides of the hub to resiliently spread apart to facilitate installation and removal of the hub from the gun barrel when said legs are squeezed toward one another.

2. The combination as claimed in claim 1, said barrel having an elongated, axially and upwardly extending rib along the upper length thereof, said rib being received within said slot and said disconnected opposite sides of the hub being respectively disposed on opposite sides of said rib.

3. The combination as claimed in claim 1, said legs diverging outwardly away from one another as they extend away from the hub.

4. The combination as claimed in claim 1, said body being constructed from a synthetic resinous material.

5. The combination as claimed in claim 1, said hub having a plurality of internal projections within said bore for spacing an interior surface of the bore away from the barrel of the gun when the support is installed thereon.

6. The combination as claimed in claim 5, said projections comprising axially extending ribs.

7. The combination as claimed in claim 1, said opposite sides of the hub being integrally joined together at a bight about which said spreading of the sides of the hub takes place, said bight being directly opposed to said slot and located between said legs.

* * * * *